US009554651B2

(12) United States Patent
Johnson

(10) Patent No.: US 9,554,651 B2
(45) Date of Patent: Jan. 31, 2017

(54) SUPPORT MEMBERS AND STORAGE ASSEMBLIES INCORPORATING THE SUPPORT MEMBERS

(71) Applicant: Electrolux Home Products, Inc., Charlotte, NC (US)

(72) Inventor: Glenn Leroy Johnson, Cold Spring, MN (US)

(73) Assignee: ELECTROLUX HOME PRODUCTS, INC., Charlotte, NC (US)

( * ) Notice: Subject to any disclaimer, the term of this patent is extended or adjusted under 35 U.S.C. 154(b) by 0 days.

(21) Appl. No.: 14/479,812

(22) Filed: Sep. 8, 2014

(65) Prior Publication Data

US 2016/0069607 A1 Mar. 10, 2016

(51) Int. Cl.

| | |
|---|---|
| ***F25D 25/02*** | (2006.01) |
| ***A47B 96/02*** | (2006.01) |
| ***A47B 96/06*** | (2006.01) |
| ***F25D 23/06*** | (2006.01) |
| *A47B 88/04* | (2006.01) |

(52) U.S. Cl.

CPC ..... *A47B 96/024* (2013.01); *A47B 88/0407* (2013.01); *A47B 96/067* (2013.01); *F25D 23/067* (2013.01); *F25D 25/021* (2013.01); *A47B 88/04* (2013.01)

(58) Field of Classification Search

CPC ..... F25D 15/02; F25D 25/02; F25D 23/067; F25D 25/021; A47B 96/024; A47B 96/066; A47B 96/1441; A47B 88/04; A47B 88/04; A47B 96/0677; F16M 13/02

USPC ..... 312/408; 211/126.1–126.3, 126.15

See application file for complete search history.

(56) References Cited

U.S. PATENT DOCUMENTS

| | | | | |
|---|---|---|---|---|
| 2,242,903 | A * | 5/1941 | Crimmel | F25D 25/021 108/26 |
| 2,660,271 | A * | 11/1953 | Hupp | B60D 1/00 403/182 |
| 3,169,813 | A | 2/1965 | Cannon et al. | |
| 3,266,858 | A | 8/1966 | Klotz | |
| 3,842,982 | A * | 10/1974 | Joyce | A47B 87/0269 206/509 |
| 4,241,668 | A | 12/1980 | Carroll | |

(Continued)

FOREIGN PATENT DOCUMENTS

| | | | | |
|---|---|---|---|---|
| EP | 1512928 | A2 * | 3/2005 | A47B 57/10 |

*Primary Examiner* — Daniel J Troy
*Assistant Examiner* — Ryan A Doyle
(74) *Attorney, Agent, or Firm* — Pearne & Gordon LLP

(57) ABSTRACT

A storage assembly can include a first storage unit and at least one support member. The at least one support member can include a support member first end and a support member second end. The at least one support member also can include a support member first portion that extends between the support member first end and the support member second end and is releasably attached to the first storage unit. The at least one support member can further include a support member second portion that extends between the support member first end and the support member second end and is joined to the support member first portion beneath the support member first portion. The storage assembly also can include a second storage unit that is secured to the support member second portion. The support member can be employed with storage units having a variety of constructs.

13 Claims, 4 Drawing Sheets

(56) References Cited

U.S. PATENT DOCUMENTS

| | | | | |
|---|---|---|---|---|
| 4,597,616 | A * | 7/1986 | Trubiano | A61G 12/00 211/113 |
| 5,205,630 | A * | 4/1993 | Welch | A47B 47/021 108/107 |
| 5,524,957 | A * | 6/1996 | Gibriano | A47C 7/70 108/26 |
| 5,820,329 | A | 10/1998 | Derbinski et al. | |
| 5,855,424 | A * | 1/1999 | Hamilton | F25D 23/067 312/406 |
| 6,460,956 | B1 | 10/2002 | Disbennett et al. | |
| 6,578,720 | B1 | 6/2003 | Wang | |
| 6,612,671 | B2 | 9/2003 | Disbennett et al. | |
| 6,729,705 | B2 | 5/2004 | Wolanin et al. | |
| 7,270,384 | B2 * | 9/2007 | Koloff, Jr. | A47B 88/04 312/330.1 |
| 7,740,331 | B2 | 6/2010 | Koo | |
| 8,408,666 | B2 | 4/2013 | Armstrong et al. | |
| 2013/0048588 | A1 * | 2/2013 | Vilkomirski | A47B 87/0215 211/153 |

* cited by examiner

SUPPORT MEMBERS AND STORAGE ASSEMBLIES INCORPORATING THE SUPPORT MEMBERS

FIELD OF THE INVENTION

The present invention relates, in general, to support members as well as storage assemblies that incorporate the support members and, in particular, to the use of the support members with storage assemblies in refrigeration appliances.

BACKGROUND OF THE INVENTION

Items and articles of one type or another that require supporting means often are supported from structures in a variety of ways, including through the use of support members. The items and articles that are supported can include, for example, shelves, racks, counters, receptacles and drawers, and the supporting structures from which the items and articles are supported can comprise, for example, walls, casings and bulkheads. In many cases, support members such as brackets and braces, for example, are employed for the purpose of supporting the items and articles from the supporting structures. In certain instances, storage units such as shelves and baskets, for example, are variously supported at the interior walls of refrigeration appliances, such as, for example, the fresh food compartments of household refrigerators. Often times, the storage units are supported at the interior walls of the refrigeration appliances by a type of supporting member such as a bracket or brace that is attached to the interior walls by fasteners. Those skilled in the art, pursuant to commercial and manufacturing incentives, continuously seek to make improvements in the technology concerning the installation and maintenance of such storage units and in the convenience and ease with which the positioning of the storage units can be adjusted at the interior walls of the refrigeration appliances.

BRIEF SUMMARY OF THE INVENTION

The following presents a simplified summary of the invention in order to provide a basic understanding of some aspects of the invention. The summary does not comprise an extensive overview of the invention nor is the summary intended to either identify key or critical elements of the invention or delineate the scope of the invention. Its sole purpose is to present some concepts of the invention in a simplified form as a prelude to the more detailed description that is presented later.

In accordance with an aspect of the present invention, a support member includes a support member first end and a support member second end. The support member also includes a support member first portion that extends between the support member first end and the support member second end. A first attaching element included with the support member first portion is located proximate the support member first end, and the first attaching element is configured to releasably suspend the support member first end at a first overhanging structure. A second attaching element included with the support member first portion is located proximate the support member second end, and the second attaching element is configured to releasably suspend the support member second end at one of the first overhanging structure and a second overhanging structure. The support member, in addition, includes a support member second portion that is joined to the support member first portion and is configured to support a depending structure for movement in relation to the support member.

According to another aspect of the invention, the support member second portion of the support member described in the previous paragraph can include an abutment that extends along at least a portion of the support member second portion between the support member first end and the support member second end and a protrusion that overhangs at least a portion of the abutment. The protrusion and the abutment can form a recess that is configured to receive at least a portion of the depending structure that is supported by the support member second portion for sliding movement of the depending structure in relation to the support member.

According to an added aspect of the invention, the first attaching element previously identified can comprise a hook that includes a hook open aspect that faces in a direction towards the support member second portion. And the second attaching element previously identified can include a slot having a slot open aspect proximate the support member second end with the slot extending from the slot open aspect toward the support member first end.

According to a further aspect of the invention, the slot previously identified can include a slot first portion and a slot second portion. The slot first portion can include the slot open aspect, and the slot second portion can be inclined in a direction away from the slot first portion toward the support member second portion.

According to an additional aspect of the invention, the hook previously identified can include a shoulder that is located at the hook open aspect and is configured to releasably restrict the separation of the hook from the first overhanging structure.

According to one more aspect of the invention, a support member can include a support member first end and a support member second end. A support member first portion can extend between the support member first end and the support member second end and can include a first attaching element located proximate the support member first end. The first attaching element can comprise a hook that is configured to releasably suspend the support member first end at a first overhanging structure. The support member first portion also can include a second attaching element located proximate the support member second end. The second attaching element can be configured to releasably suspend the support member second end to one of the first overhanging structure and a second overhanging structure. The second attaching element can include a slot that includes a slot first portion and a slot second portion. The slot first portion can have a slot open aspect proximate the support member second end, and the slot second portion can extend toward the support member first end in an inclined attitude away from the slot first portion. The support member also can include a support member second portion that is joined to the support member first portion and is configured to slidably support a depending structure.

According to yet another aspect of the invention, with the support member described in the immediately preceding paragraph, the hook can include a hook open aspect that faces in a direction toward the support member second portion. The hook also can include a shoulder that is located at the hook open aspect, the shoulder being configured to releasably restrict the separation of the hook from the first overhanging structure.

According to yet an added aspect of the present invention, a storage assembly can include a first storage unit and at least one support member. The at least one support member can include a support member first end and a support member second end. The at least one support member also can include a support member first portion that extends between the support member first end and the support member second end and is releasably attached to the first storage unit. The at least one support member can further include a support member second portion that extends between the support member first end and the support member second end and is joined to the support member first portion beneath the support member first portion. The storage assembly also can include a second storage unit that is secured to the support member second portion.

According to yet a further aspect of the invention, with the storage assembly previously described, the support member first portion can include a first attaching element that is located proximate the support member first end and is configured to releasably suspend the support member first end at the first storage unit. The support member first portion also can include a second attaching element that is located proximate the support member second end and is configured to releasably suspend the support member second end at the first storage unit.

According to yet an additional aspect of the invention, with the storage assemblies previously described, the first storage unit can include a first support rod and a second support rod spaced from the first support rod. The first support rod and the second support rod can be arranged substantially parallel to one another and can extend generally transversely of the direction in which the at least one support member extends between the support member first end and the support member second end. The first attaching element can be releasably suspended at the first support rod of the first storage unit, and the second attaching element can be releasably suspended at the second support rod of the first storage unit.

According to yet one more aspect of the invention, with the storage assemblies previously described, the support member second portion and the second storage unit can be configured to be secured to one another in a manner to provide for the second storage unit to move between a position underneath the first storage unit and a position at least partially withdrawn from underneath the first storage unit.

According to still another aspect of the invention, with the storage assemblies previously described, the support member second portion can include an abutment that extends along at least a portion of the at support member second portion between the support member first end and the support member second end and provides vertical support to the second storage unit. The second storage unit can include a projection that rests on the abutment, with the abutment and the projection being configured to cooperatively provide for the second storage unit to move between a position underneath the first storage unit and a position at least partially withdrawn from underneath the first storage unit.

According to still an additional aspect of the invention, with the storage assemblies previously described, the support member second portion can include a protrusion that overhangs at least a portion of the abutment. The protrusion and the abutment can form a recess in which the projection of the second storage unit is located.

According to still a further aspect of the invention, with the storage assemblies previously described, the second attaching element can include a slot that includes a slot first portion and a slot second portion. The slot second portion can be being nearer the first attaching element than the slot first portion. The slot second portion can be inclined in a direction away from the slot first portion downwardly toward the support member second portion.

According to still an added aspect of the invention, with the storage assemblies previously described, the first attaching element can be configured to prevent the at least one support member from moving in a direction downwardly of the first storage unit and in directions forwardly and rearwardly of the first storage unit.

According to still one more aspect of the invention, with the storage assemblies previously described, the first attaching element can be configured to be secured to the first storage unit so as to releasably restrict the at least one support member from moving upwardly of the first storage unit.

According to an additional aspect of the invention, the storage assemblies previously described can be located in the interior of a compartment of a refrigeration appliance.

According to a further aspect of the invention, with the storage assemblies located in the compartment of a refrigeration appliance, the refrigeration appliance can include a first wall that includes a first wall interior surface and a second wall that includes a second wall interior surface. The first wall and the second wall can be positioned opposite one another on either side of an opening to the interior of the refrigeration appliance. In the instances in which the first storage unit includes a first support rod and a second support rod, each of the first support rod and the second support rod can include a first end that is located in a respective opening in the first wall interior surface. And each of the first rod and second rod can include a second end that is located in a respective opening in the second wall interior surface.

According to an added aspect of the invention, with the storage assemblies previously described, the at least one support member can comprise a first support member and a second support member. The first support member can be located proximate the first wall interior surface and the second support member can be located proximate the second wall interior surface.

The following description and accompanying drawings set forth in detail certain illustrative aspects of the invention. These aspects are indicative, however, of but a few of the various ways in which the principles of the invention may be employed, and the present invention is intended to include all aspects of the invention and their equivalents. Other objects, advantages and novel features of the invention will become apparent from the following detailed description of the invention when considered in conjunction with the accompanying drawings.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DESCRIPTION OF EXAMPLE EMBODIMENTS

Figure 1:
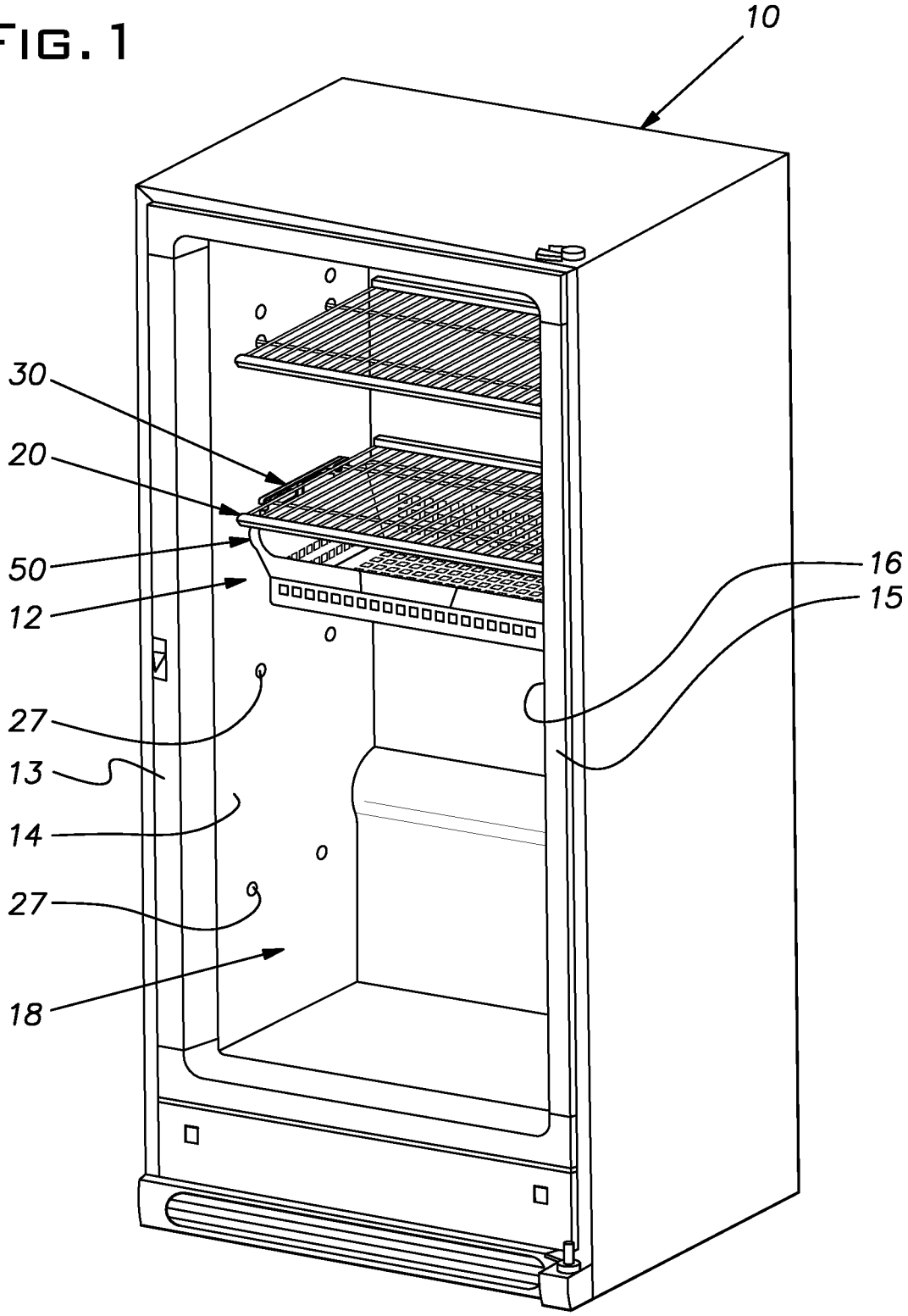
FIG. 1 is a perspective view of an example of a storage assembly located within the fresh food compartment of a household refrigerator in accordance with an aspect of the invention.

The present invention will now be described with reference to the drawings, wherein like reference numerals are used to refer to like elements throughout. It is to be appreciated that the various drawings are not necessarily drawn to scale from one figure to another or within a given figure. The sizes of the components are somewhat arbitrarily drawn for facilitating the understanding of the drawings. In the following description, numerous specific details are set forth in order to provide a thorough understanding of the present invention, but it can be possible in certain instances to practice the present invention without those specific details.

Referring first to FIG. 1, there is illustrated an example of an embodiment of a storage assembly, indicated generally at 12, located, for example, in the interior of a refrigeration appliance, indicated generally at 10, such as the fresh food compartment of the refrigeration appliance, in accordance with the principles of the invention. It will be understood and appreciated by those having ordinary skill in the art, particularly based on the detailed description that follows, that the storage assemblies of the invention can be located within various refrigeration appliances, including for example commercial refrigeration equipment and household refrigerators. And the storage assemblies can be located in both the fresh food compartments, as depicted in FIG. 1, and the freezer compartments of such refrigeration appliances as well as in specialized compartments of refrigeration appliances. In addition, the storage assemblies of the invention can be located in appliances other than refrigeration appliances as well as in other kinds of storage cabinets and closets. Thus, the storage assemblies of the invention can be located within or in cooperation with essentially any type of storage facility that includes structures for maintaining the storage assemblies in place.

Again referring to FIG. 1, the compartment of the refrigeration appliance 10 includes a first wall 13 that includes a first wall interior surface 14 and a second wall 15 that includes a second wall interior surface 16. The first wall 13 and the second wall 15 are positioned opposite one another on either side of an opening, indicated generally at 18, to the interior of the fresh food compartment of the refrigeration appliance 10, for example, where the storage assembly 12 is located. A freezer compartment can be located at the bottom of the interior of the refrigeration appliance and isolated from the fresh food compartment by insulated partitions not shown in FIG. 1. Also not shown in FIG. 1 is the door of the refrigeration appliance that closes off and provides access to the interior of the refrigeration appliance as will be understood by those having ordinary skill in the art.

Figure 3:
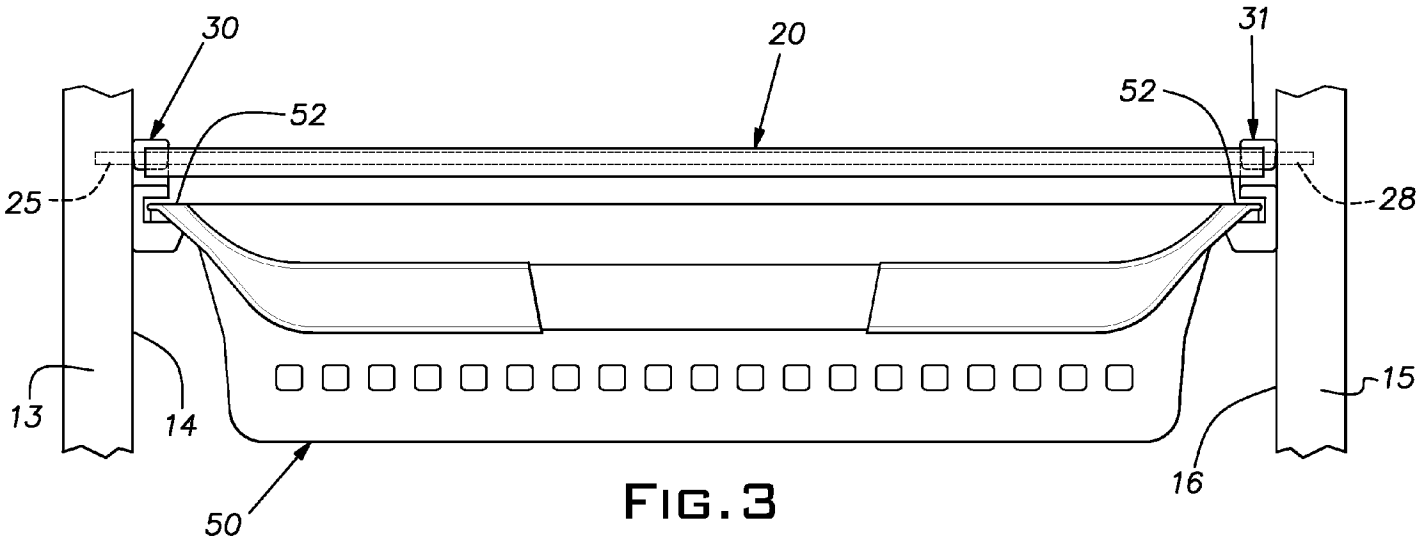
FIG. 3 is a partial front elevational view of the storage assembly and refrigerator of FIG. 1.
Figure 4:
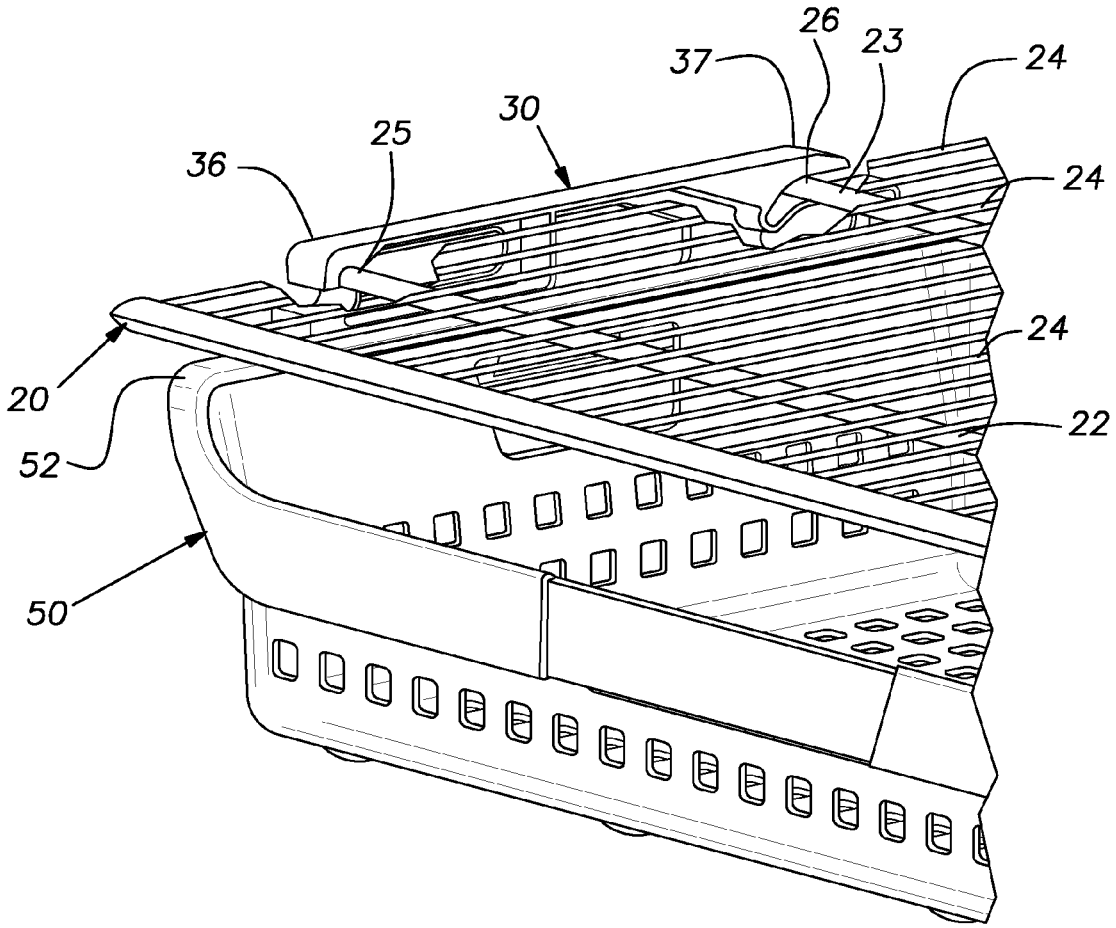
FIG. 4 is a partial perspective view of the storage assembly of FIGS. 1 and 3 with some elements broken away to reveal certain underlying structures of the storage assembly.

As can be seen in FIGS. 1, 3 and 4, where an example of an embodiment of the storage assembly of the invention is shown in different attitudes, the storage assembly can include a first storage unit, indicated generally at 20, and a second storage unit, indicated generally at 50, joined to one another by at least one support member. As shown in FIG. 3, the at least one support member can comprise a first support member, indicated generally at 30, that is located proximate the first wall interior surface 14 of the compartment of the refrigeration appliance 10 and an essentially identical second support member, indicated generally at 31, located proximate the second wall interior surface 16 of the compartment of the refrigeration compliance 10. As used throughout the description of the invention and in the claims related thereto, the word "proximate" is intended to mean not only "near" or "adjacent" but also "at" a particular location. Thus, for example, the description of the first support member 30 as being located proximate the first wall interior surface 14 means that the support member 30 can be located both near or adjacent the first wall interior surface 14 and at, or in contact with, the first wall interior surface 14.

Figure 2:
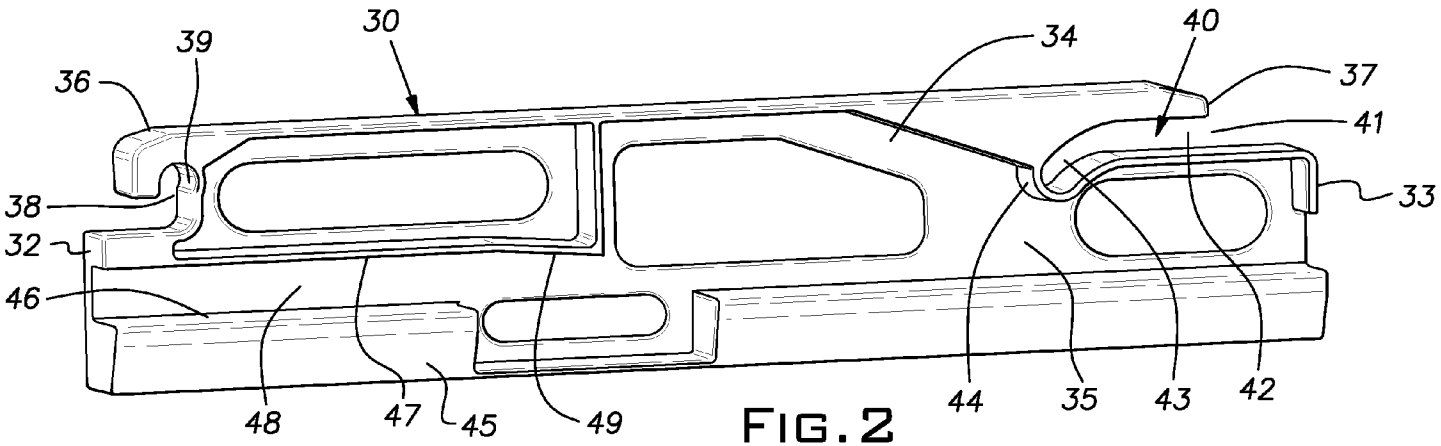
FIG. 2 is a perspective view of an example of a support member that comprises an aspect of the invention.

Turning now to a description of the first support member 30 and the second support member 31, FIG. 2 is a perspective view of an example of the first support member 30. It will be understood that the description that follows of the first support member 30, with reference to FIG. 2, also applies to the second support member 31 since in the particular example of the storage assembly embodiment described and illustrated herein, the first support member 30 and the second support member 31 are essentially identical. However, the first support member and the second support member can have different constructs if desired.

The first support member 30 includes a support member first end 32 and a support member second end 33 with the first support member 30 extending between the support member first end 32 and the support member second end 33 in essentially a straight line. The first support member 30 includes a support member first portion 34 extending between the support member first end 32 and the support member second end 33 and a support member second portion 35 extending between the support member first end 32 and the support member second end 33. The support member second portion 35 is joined to the support member first portion 34 beneath the support member first portion 34. As used herein in the description of the invention and the claims, the words "beneath" and "underneath" are intended to refer to the first support member 30, the second support member 31 and the storage assembly 12 as they are viewed when in place in a refrigeration appliance as shown, for example, in FIG. 1. As described in greater detail below, the support member second portion 35 is configured to support a depending structure, such as the second storage unit 50 for example, for movement in relation to the support member 30. More specifically with reference to the example embodiment shown in the figures, the support member second portion 35 can be configured to slidably support the depending structure as discussed below in greater detail.

The support member first portion 34 includes a first attaching element 36 located proximate the support member first end 32. As described in greater detail below, the first attaching element 36 is configured to releasably suspend the support member first end 32 at a first overhanging structure such as a component of the first storage unit 20 for example. The support member first portion 34 also includes a second attaching element 37 located proximate the support member second end 33. Also as described in greater detail below, the second attaching element 37 is configured to releasably suspend the support member second end 33 at one of the first overhanging structure or a second overhanging structure. Thus, the second attaching element 37 can suspend the support member from the same structure as the structure from which the first attaching element 36 suspends the support member or from a different structure. In either event, as a consequence, in the illustrated example of the storage assembly 12, the support member first portion of at least one support member is releasably secured to the first storage unit by each of the first attaching element and the second attaching element.

In the example of the embodiment of the first support member 30 shown in FIG. 2, the first attaching element 36 comprises a hook including a hook open aspect 38 that faces in a direction towards the support member second portion 35 of the first support member 30. The hook includes a shoulder 39 that is located at the hook open aspect 38. The shoulder 39 is configured to releasably restrict the separation of the hook from the first overhanging structure such as a component of the first storage unit as described in greater detail below.

Also in the example of the embodiment of the first support member 30 shown in FIG. 2, the second attaching element 37 includes a slot, indicated generally at 40. The slot 40 includes a slot open aspect 41 proximate the support member second end 33. The slot 40 extends from the slot open aspect towards the support member first end 32. In this connection, the slot 40 includes a slot first portion 42 and a slot second portion 43. The slot first portion 42 includes the slot open aspect 41, and the slot second portion 43 is inclined in a direction away from the slot first portion 42 towards the support member second portion 35 and terminates at slot closed end 44. Stated otherwise, the slot second portion 43 extends toward the support member first end 32 in an inclined attitude away from the slot first portion 42. In this respect, the slot second portion 42 is nearer the first attaching element 36 than the slot first portion 41.

As shown in the example of the embodiment illustrated in the figures, the support member second portion 35 includes an abutment 45 that extends along at least a portion of the support member second portion 35 between the support member first end 32 and the support member second end 33. The abutment 45 includes an accompanying abutment surface 46. The abutment surface 46 in the example embodiment is configured to essentially lie in a single plane and to be substantially horizontally arranged when the at least one support member is in place in a storage assembly such as the storage assembly 12 for example. As described in greater detail below, the abutment 45 provides vertical support to the second storage unit 50 when the at least one support is in place in the storage assembly 12.

The support member second portion 35 also includes a protrusion 47 that overhangs the abutment 45 along at least a portion of the abutment. The abutment 45 and the protrusion 47 form and define a recess 48 in the support member second portion 35. As described in greater detail below, the recess 48 is configured to receive at least a portion of a depending structure, such as the second storage unit 50 for example, and support the depending structure for sliding movement in relation to the support member 30. The protrusion 47 can include a protrusion inclined portion 49 that is inclined downwardly above a gap in the abutment 45. The protrusion inclined portion 49 restricts the second storage unit 50 from being completely withdrawn from the support member 30, as described in further detail below. And the gap in the abutment 45 facilitates the installation of the second storage unit 50 at the support member 30, also as further described below.

Turning now to a description of the example embodiment of the storage assembly 12 of the present invention and the incorporation therein of at least one support member such as first support member 30 or second support member 31 for example, it can be seen from FIGS. 1, 3 and 4 that the storage assembly 12 includes the first storage unit 20, at least one support member such as first support member 30 or second support member 31, and the second storage unit 50. As can be understood from the previous description, the support member includes a support member first end 32, a support member second end 33, a support member first portion 34 that extends between the support member first end 32 and the support member second end 33 and a support member second portion 35 that also extends between the support member first end 32 and the support member second end 33 and is joined to the first member first portion 34 beneath the support member first portion. The support member first portion 34 is releasably attached to the first storage unit 20 and the second storage unit 50 is secured to the support member second portion 35.

As indicated above, the support member first portion 34 includes the first attaching element 36 that is located proximate the support member first end 32 and is configured to releasably suspend the support member first end 32 at the first storage unit 20. Also as indicated above, the support member first portion includes the second attaching element 37 that is located proximate the support member second end 33 and is configured to releasably support the support member second end 33 at the first storage unit 20.

In the example embodiment of the storage assembly 12 shown in the figures, the first storage unit 20 is depicted to comprise a wire shelf of a kind that is known to those having ordinary skill in the art as useful for shelving in refrigeration appliances as well as in other kinds of storage facilities. However, the storage assembly of the invention is not limited to the first storage unit 20 comprising wire shelving. Other types of first storage units such as, for example, glass shelving can comprise the first storage unit 20. As can be seen in the figures including FIG. 4, which comprises a partial perspective view of the storage assembly 12 as it appears when installed in the refrigeration appliance 10, the first storage unit 20 includes a first support rod 22 and a second support rod 23 that is spaced from the first support rod. The first support rod 22 and the second support rod 23 are attached to the wires 24 of the first storage unit 20 by welding or by an adhesive, for example, and are arranged substantially parallel to one another and extend generally transversely of the direction in which the first support member 30 extends between the support member first end 32 and the support member second end 33.

Figure 5:
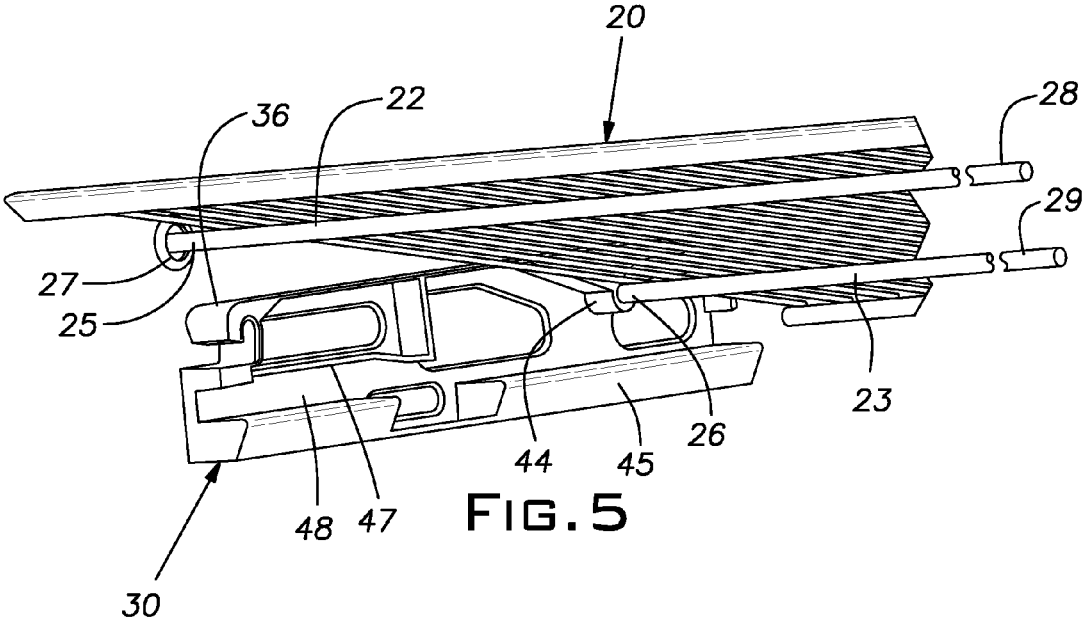
FIG. 5 is a partial perspective view that illustrates a first intermediate step in the assembling of the storage assembly of FIGS. 1, 3 and 4.
Figure 6:
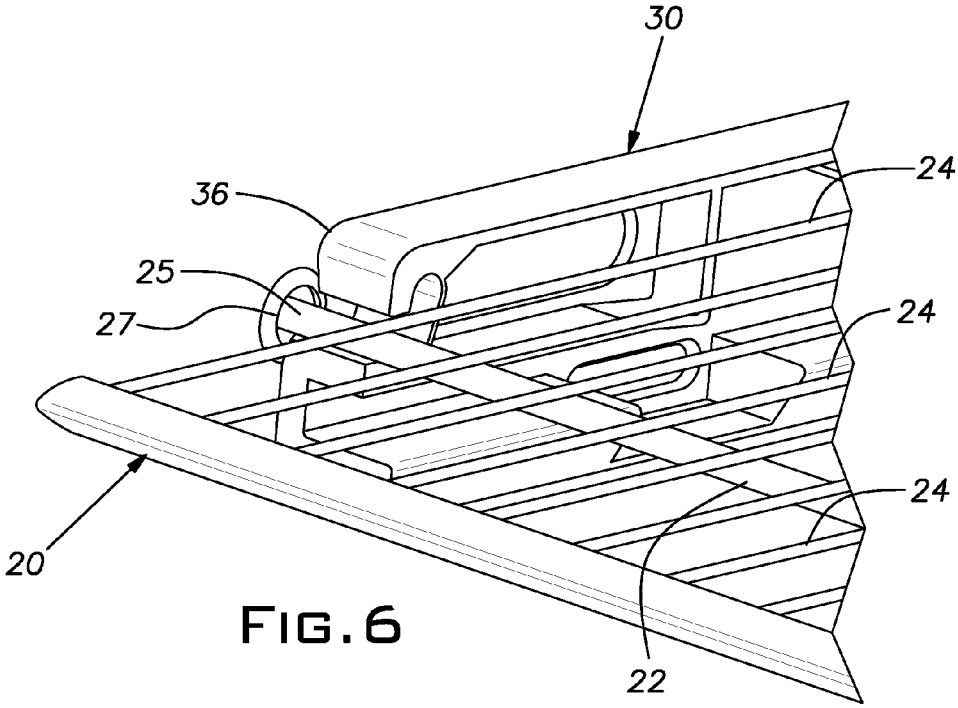
FIG. 6 is a partial perspective view that illustrates a second intermediate step in the assembling of the storage assembly of FIGS. 1, 3 and 4.

As best seen in FIGS. 5 and 6, each of the first support rod 22 and the second support rod 23 includes a first end, 25 in the case of first support rod 22 and 26 in the case of second support rod 23, that is located in a respective opening 27 in the first wall interior surface 14, and each of the first support rod 22 and the second support rod 23 includes a second end, 28 in the case of first support rod 22 and 29 in the case of second support rod 23, that is located in a respective opening 27 in the second wall interior surface 16.

As shown in FIG. 4, the first attaching element 36 of the first support member 30 is releasably suspended at the first support rod 22 of the first storage unit 20 proximate the first end 25 of the first support rod 22, and the second attaching element 37 of the first support member 30 is releasably suspended at the second support rod 23 of the first storage unit 20 proximate the first end 26 of the second support rod 23. In the case of the second support member 31, the first attaching element 36 of the second support member 31 is releasably suspended at the first support rod 22 of the first storage unit 20 proximate the second end 28 of the second support rod 22, and the second attaching element 37 of the second support member 31 is releasably suspended at the second support rod 23 of the first storage unit 20 proximate the second end 29 of the second support rod 23.

The second storage unit 50, which in the example embodiment shown in the figures comprises a basket that is located underneath at least most of the first storage unit 20 from front to back, and the support member second portion 35 are configured to be secured to one another to provide for the second storage unit to move between a position underneath the first storage unit 20 and a position at least partially withdrawn from underneath the first storage unit 20 when the storage assembly 12 is installed in the refrigeration appliance 10.

The second storage unit 50 includes projections 52 that extend along at least portions of both sides of the basket adjacent, respectively, the first wall interior surface 14 and the second wall interior surface 16 from the front of the basket to the rear of the basket. As can be seen in FIG. 3, each projection 52 rests on an abutment surface 46 of an abutment 45, the abutment thereby providing vertical support to the second storage unit 50. More specifically, each projection 52 of the second storage unit 50 is located in a respective recess 48 of the first support member 30 and the second support member 31. Thus, the abutment 45 that cooperatively with the protrusion 47 forms the recess 48, and the projections 52 are configured to provide for the second storage unit 50 to move between a position underneath the first storage unit 20 and a position at least partially withdrawn from underneath the first storage unit by respectively pulling and pushing on the front of the storage unit 50 and causing the projections 52 of the storage unit 50 to slide along the abutment surfaces 46.

One of the features of the present invention concerns the facility with which the storage assembly 12 can be initially installed and thereafter repositioned as desired within the interior of the refrigeration appliance 10. The first step in such an installation or repositioning involves mounting the first storage unit 20 at the interior of the refrigeration appliance 10. This is accomplished by inserting the first ends 25 and 26 of the first support rod 22 and second support rod 23, respectively, within respective openings 27 that can be located at a number of sites in the first wall interior surface 14 of the refrigeration appliance 10. The openings 27 are sufficiently deep so that the first ends of the first and second rods can be inserted into the openings to an extent that the second ends of the first and second rods are clear of the second wall interior surface 16 of the refrigeration appliance and can be inserted in openings at the second wall interior surface 16 by withdrawing, to a degree, the first ends of the first and second ends from the respective openings in which they have been inserted.

With the first storage unit 20 in place, the first support member 30 is attached to the first end 26 of the second support rod 23 by sliding the support member 30 onto the first end 26 of the second support rod 23 at the slot open aspect 41 of the first support member 30. The first end 26 of the second support rod 23 is inserted into the slot 40 of the first support member 30 a sufficient distance so that the first end 26 of the second support rod 23 reaches the closed end 44 of the second portion 43 of the slot 41. The downward inclination of the second portion 43 of the slot 40 allows the first end 32 of the first support member 30 to be maintained at this juncture beneath the first storage unit 20 as shown in FIG. 5. In addition, the spacing between the first support rod 22 and the second support rod 23 is such that when the first support member 30 is in the position shown in FIG. 5, the attaching element of the first support member 30 is located in back of the first support rod 22. Consequently, the first support member 30 can be raised and moved forward to a position such that the attaching element 36 is directly above the first support rod 22 as shown in FIG. 6. The forward movement of the support member 30 is accommodated by the first end 26 of the second support rod sliding in the slot 40 toward the slot open aspect 41 and coming to rest at the first portion 42 of the slot 40. The first end 32 of the first support member 30 can then be moved downwardly and the first attaching element 36 forced past the shoulder 39 onto the first end 25 of the first support rod 22 to a position as illustrated in FIG. 4. In this regard, the open aspect 38 of the first attaching element 36 at the shoulder 39, in those instances in which the shoulder is provided, can be dimensionally shorter than the diameter of the first end 25 of the first supporting rod 22 so that the first attaching element 36 must be forced onto the first end 25 of the first supporting rod 22. It will be understood by those of ordinary skill in the art that the second support member 31 can be releasably secured to the second ends 28 and 29 of the first support rod 22 and the second support rod 23, respectively, in a similar manner as described with respect to first support member 31.

With the foregoing described arrangement, the first attaching element 36 is configured to prevent the support member from moving in a direction downwardly of the first storage unit 20 and in a direction forwardly and rearwardly of the first storage unit 20. Additionally, the first attaching element 36 is configured to be secured to the first storage unit 20 so as to releasably restrict the support member from moving upwardly from the first storage unit 20. That releasable restriction is provided by the shoulder 39 in those instances in which it is included at the first attaching element 36.

Once the first storage unit 20 has been installed and the support members suspended from the first storage unit, the second storage unit 50 is installed at the support members by inserting the projections 52 of the second storage unit 50 into the recesses 48 provided in the support members and sliding the second storage unit 50 along the recesses 48 to a position underneath the first storage unit 20. In the case in which the protrusion inclined portion 49 is provided at one or both of the support members 30 and 31, when the second storage unit 50 is installed at the support members, the projections 52 of the second storage unit 50 will encounter the protrusion inclined portion 49 as the second storage unit is moved further along the recesses 48 in the support members and further beneath the first storage unit 20. It is necessary at that point to raise the front of the second storage unit 50, thereby lowering the rear of the second storage unit into the gap that lies below the protrusion inclined portion 49. The second storage unit 50 can then be caused to enter further along the recesses 48 and further beneath the first storage unit 20 as the front of the second storage unit is at the same time levelled off so that the second storage unit will slide past the protrusion inclined portion 49 and be moved to a closed position essentially entirely beneath the first storage unit 20. The protrusion inclined portion 49 provides a degree of frictional resistance to the movement of the second storage unit 50 at the support members, thereby preventing the second storage unit 50 from being too easily accidentally completely withdrawn from the support members 30 and 31. At the same time, the protrusion inclined portion 49 is not so rigid that it causes the second storage unit 50 to become jammed in the support members.

The invention has been described above using specific examples; however, it will be understood by those having ordinary skill in the art that various alternatives may be used and equivalents may be substituted for elements or steps described herein without deviating from the scope of the invention. Modifications may be necessary to adapt the invention to a particular situation or to particular needs without departing from the scope of the invention. It is intended that the invention not be limited to the particular implementation described herein, but that the claims be given their broadest interpretation to cover all embodiments, literal or equivalent, covered thereby.

What is claimed is:

1. A refrigeration appliance including a support member including:

a support member first end and a support member second end;

a back wall extending between and connecting the support member first end and the support member second end;

a support member first portion extending between the support member first end and the support member second end and including:

a first attaching element located proximate the support member first end and configured to releasably suspend the support member first end at a first overhanging structure, the first attaching element comprising a hook including a hook open aspect that faces in a direction toward the support member second portion; and a second attaching element located proximate the support member second end and configured to releasably suspend the support member second end at one of the first overhanging structure and a second overhanging structure, the second attaching element including a slot defined between a slot closed end and a slot open aspect proximate the support member second end, the slot extending from the slot open aspect toward the support member first end, wherein the slot includes a slot first portion and a slot second portion, the slot first portion including the slot open aspect, and the slot second portion being inclined in a direction away from the slot first portion toward the support member second portion; and a support member second portion joined to the support member first portion via the back wall and configured to slidably support a depending structure for movement in relation to the support member, wherein the support member second portion is located beneath the support member first portion, and a recessed channel is disposed vertically between the support member first portion and the support member second portion, wherein the recessed channel extends between the support member first end and the support member second end to receive the depending structure for sliding movement in relation to the support member.

2. The refrigeration appliance including the support member of claim 1, wherein the hook includes a shoulder located at the hook open aspect, the shoulder configured to releasably restrict the separation of the hook from the first overhanging structure.

3. A refrigeration appliance including a storage assembly including:

a first storage unit;

at least one support member including:

a support member first end and a support member second end;

a back wall extending between and connecting the support member first end and the support member second end;

a support member first portion extending between the support member first end and the support member second end and releasably attached to the first storage unit, the support member first portion including:

a first attaching element located proximate the support member first end and configured to releasably suspend the support member first end at the first storage unit, and a second attaching element located proximate the support member second end and configured to releasably suspend the support member second end at the first storage unit, wherein the second attaching element includes a slot that includes a slot first portion and a slot second portion, the slot second portion being nearer the first attaching element than the slot first portion, and the slot second portion being inclined in a direction away from the slot first portion downwardly toward the support member second portion; and a support member second portion extending between the support member first end and the support member second end and joined to the support member first portion, via the back wall, beneath the support member first portion, wherein a recessed channel is disposed vertically between the support member first portion and the support member second portion; and a second storage unit slidably secured to the support member second portion and received within the recessed channel for sliding movement in relation to the at least one support member.

4. The refrigeration appliance including the storage assembly of claim 3, wherein:

the first storage unit includes a first support rod and a second support rod spaced from the first support rod, the first support rod and the second support rod being arranged substantially parallel to one another and extending generally transversely of the direction in which the at least one support member extends between the support member first end and the support member second end;

the first attaching element is releasably suspended at the first support rod of the first storage unit; and the second attaching element is releasably suspended at the second support rod of the first storage unit.

5. The refrigeration appliance including the storage assembly of claim 4, wherein the support member second portion and the second storage unit are configured to be secured to one another to provide for the second storage unit to move between a position underneath the first storage unit and a position at least partially withdrawn from underneath the first storage unit.

6. The refrigeration appliance including the storage assembly of claim 5, wherein the support member second portion includes an abutment extending along at least a portion of the support member second portion between the support member first end and the support member second end and providing vertical support to the second storage unit, the second storage unit including a projection that rests on the abutment, and the abutment and the projection being configured to cooperatively provide for the second storage unit to move between the position underneath the first storage unit and the position at least partially withdrawn from underneath the first storage unit.

7. The refrigeration appliance including the storage assembly of claim 6, wherein the support member second portion includes a protrusion overhanging at least a portion of the abutment, the protrusion and the abutment forming the recessed channel in which the projection of the second storage unit is located.

8. The refrigeration appliance including the storage assembly of claim 7, wherein the first attaching element is configured to prevent the at least one support member from moving in a direction downwardly of the first storage unit and in directions forwardly and rearwardly of the first storage unit.

9. The refrigeration appliance including the storage assembly of claim 8, wherein the first attaching element is configured to be secured to the first storage unit so as to releasably restrict the at least one support member from moving upwardly of the first storage unit.

10. The refrigeration appliance including the storage assembly of claim 7, wherein the storage assembly is located in the interior of a compartment of said refrigeration appliance.

11. The refrigeration appliance including the storage assembly of claim 10, wherein:

the compartment of the refrigeration appliance includes a first wall that includes a first wall interior surface and a second wall that includes a second wall interior surface, the first wall and the second wall being positioned opposite one another on either side of an opening to the interior of the refrigeration appliance;

each of the first support rod and the second support rod includes a first end that is located in a respective opening in the first wall interior surface; and each of the first support rod and second support rod includes a second end that is located in a respective opening in the second wall interior surface.

12. The refrigeration appliance including the storage assembly of claim 11, wherein the at least one support member includes a first support member and a second support member, the back wall of the first support member being located proximate the first wall interior surface and the back wall of the second support member being located proximate the second wall interior surface.

13. The refrigeration appliance including the storage assembly of claim 4, wherein the slot second portion is configured to receive the second support rod so that the at least one support member can rotate upwards such that the first attaching element is raised and moved forward to a position located directly above the first support rod.

* * * * *